United States Patent [19]

Bauch et al.

[11] 4,232,494

[45] Nov. 11, 1980

[54] COMPOSITE CONSTRUCTION PANEL

[75] Inventors: Tamil D. Bauch, Box 394 B, R.F.D. 1, Kingston, N.Y. 12401; Hank Starr, Kingston, N.Y.

[73] Assignee: Tamil D. Bauch, Kingston, N.Y.

[21] Appl. No.: 33,892

[22] Filed: Apr. 27, 1979

[51] Int. Cl.[3] ..... E04B 2/02; E04C 2/24; B32B 5/18

[52] U.S. Cl. ..... 52/221; 52/220; 52/309.12; 52/584; 428/70; 428/71; 428/310; 428/920

[58] Field of Search ..... 52/309.12, 309.17, 220, 52/221, 584, 602; 428/70, 71, 310, 920, ; 264/46.4, 46.5, 46.6, 333

[56] References Cited

U.S. PATENT DOCUMENTS

| | | | |
|---|---|---|---|
| 3,295,278 | 1/1967 | Muhm | 428/310 |
| 3,750,355 | 8/1973 | Blum | 428/310 |
| 3,854,535 | 12/1974 | Kehr et al. | 428/921 |
| 3,984,957 | 10/1976 | Piazza | 428/310 |
| 4,010,232 | 3/1977 | Labrecque | 428/310 |
| 4,084,362 | 4/1978 | Piazza | 52/309.12 |

FOREIGN PATENT DOCUMENTS

| | | | |
|---|---|---|---|
| 937149 | 11/1973 | Canada | 428/310 |

*Primary Examiner*—William J. Van Balen
*Attorney, Agent, or Firm*—Natter & Natter

[57] ABSTRACT

A composite construction panel and process for its fabrication. The contruction panel has a lightweight cellular insulation core adapted for receiving imbedded electrical conduits and further includes a cementatious fireproofing layer. The panel is completely clad within glass fiber reinforced concrete. In addition, reinforcing steel can be incorporated into the concrete encasement. Adjacent panels are designed for bolted and/or adhesive interconnection with registration of the respective conduits thus forming a continuous internal conduit network. The method of fabrication includes a molding operation wherein a rigid foam core is formed from a flowable urethane composition, the core is bonded to the fireproofing layer and then enveloped within a cement matrix having glass fibers. Mold inserts are utilized to provide void areas such as for window and door openings, bolt connection pockets and utility box placement. The panel can be manufactured in planar and simple and compound curve shapes.

10 Claims, 13 Drawing Figures

FIG. 1
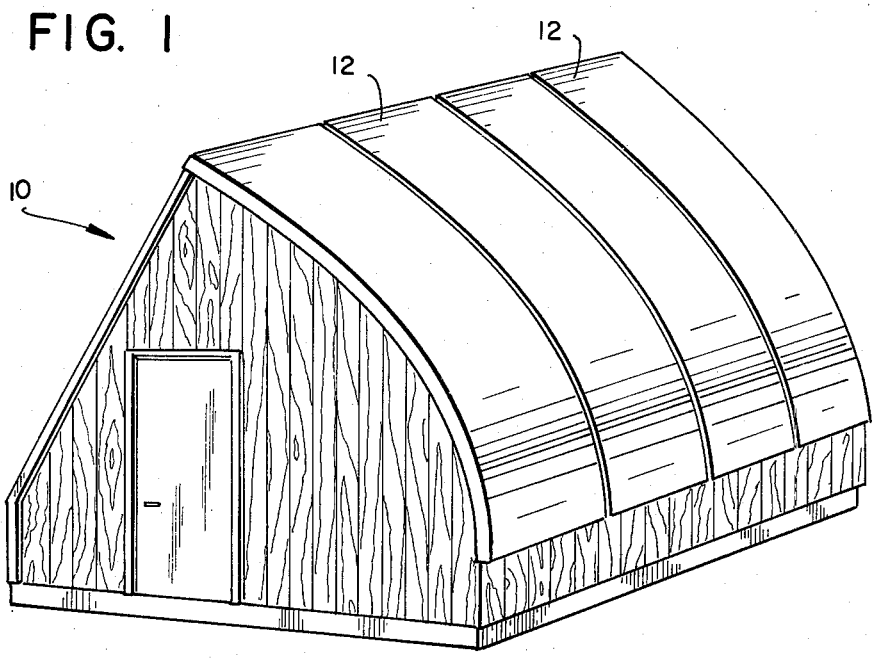
FIG. 5
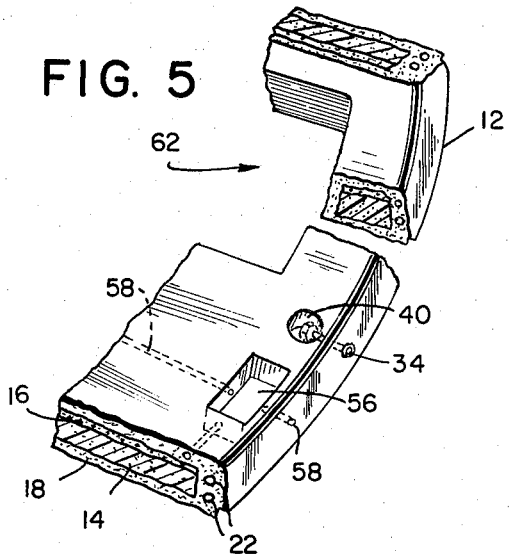
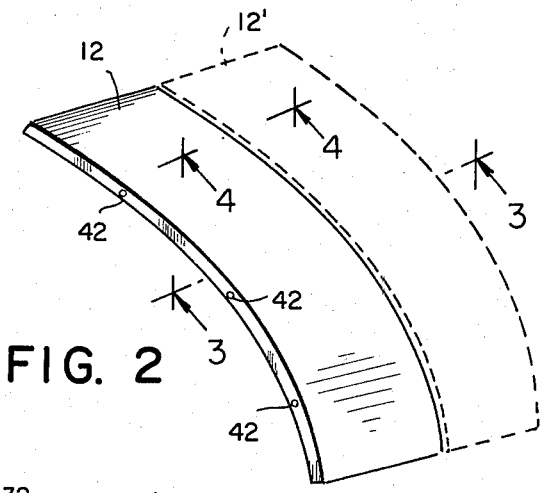
FIG. 2
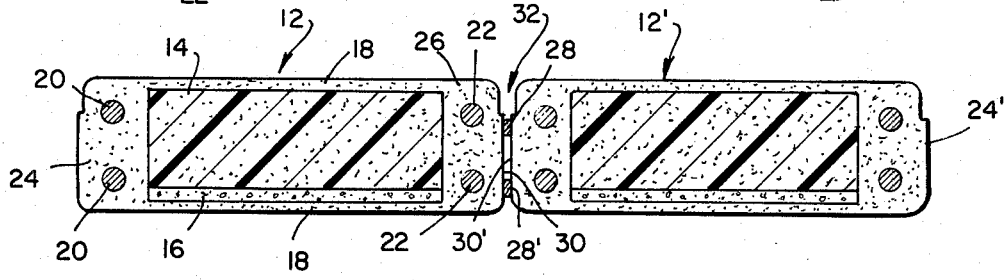
FIG. 3

COMPOSITE CONSTRUCTION PANEL

BACKGROUND OF THE INVENTION

1. Field of the Invention

This invention relates generally to improvements in static structural elements and especially to precast composite building modules and to the method of their manufacture.

In particular, the construction panel of this invention concerns preformed concrete sandwich panels which bond dissimilar construction materials to form lightweight, load bearing units having acoustical and thermal insulating properties.

The process for forming the composite construction panel of this invention further involves a continuous molding operation with provisions for incorporation of electrical conduit and access openings.

2. Description of the Prior Art

The development of lightweight precast construction panels has been gradual and not without many shortcomings. Initial attempts to reduce the weight of concrete structural elements included the introduction of filler additives to the aggregate. This, however, was detrimental to the strength and durability characteristics of the concrete. Another technique for bonding lightweight materials with concrete utilized a plurality of laminations having interconnecting dowels such as described in U.S. Pat. No. 3,295,278. The effectiveness of that bond method and the availability of different panel shapes and sizes were, however, severely limited. A further system of adhering concrete to a plastic foam layer was noted in U.S. Pat. No. 4,010,232 wherein a flowable foam mixture was poured upon a blanket of powdered dry cement. The so formed slab did not comprise a complete encasement of the foam material, and it was questionable whether that system did in effect produce a unitary structure.

A further attempt to overcome the problem of accomplishing a composite structure employed precast concrete shells into which a flowable foam composition was placed. The module formed by this procedure differed substantially from the prefabrication process and product of the instant invention. The present invention requires no premolding of relatively fragile or brittle glass fiber reinforced concrete shell components as in the method described in U.S. Pat. No. 3,984,957, and consequently the thickness of the glass fiber reinforced layers can be designed to meet the loading requirements of the building panel without any additional loads being taken into consideration for fabrication purposes.

In contrast to the previously described structures and methods of fabrication, this invention provides an improved process for forming a composite construction panel which overcomes many of the noted disadvantages.

It will be apparent that the method of this invention provides for an improved bonding of a plastic foam core within reinforced concrete encasement in a manner having distinct advantages over the prior art.

SUMMARY OF THE INVENTION

Briefly, the nature of this invention concerns a composite construction panel utilizing a lightweight modular design having both insulating and fireproofing capabilities. The method of fabricating the panels produces an effective bonding between the dissimilar sandwiched materials to form an integral structural unit. The purpose for the composite construction panel is to provide an expedient method of low cost building construction.

The composite construction panel includes an inner cellular core molded from a flowable urethane polymer composition or similar material which becomes rigid upon setting and conforms to a mold contour. The rigid core is placed upon a bed of cement based materials having a workably plastic consistency. Uniform downward pressure is applied to the core in conjunction with vibration to effect intimate surface contact. Subsequently, an exposed top and side portion of the core is covered with a skin formed of a cement matrix containing glass fibers. A pair of opposed lateral rib cavities on either side of the core are then filled with the glass fiber reinforced cement. Reinforcement, such as steel bars, may optionally be inserted in the lateral rib cavities. The resultant construction panel combines the various materials in an integrally bonded, load bearing unit suitable for versatile applications as for building modules.

An important feature of this invention concerns the flexibility as to the size and shape of the panels which are available through this molding process.

Another advantage of the composite construction panel of this invention is that, in forming the foam core, mold inserts can be used for providing openings in the finished panel such as for doors, windows, vents, ducts, utility boxes and for connection access purposes.

In addition, an electrical conduit can be incorporated into the foam core with connective couplings exiting from the finished panel in registration with adjacent panels for interconnection to form a continuous network of electrical conduits throughout the finished structure.

If desired, the reinforcing steel utilized in the panel can be prestressed or poststressed. The incorporation of fiberglass in the cement matrix serves to reinforce and strengthen the panel without adding appreciably to the weight. It should further be apparent that the improved construction panel of this invention is weather resistant, noncombustible, resistant to fungus and insects, relatively maintenance free, and has a high strength to weight ratio as compared to reinforced concrete. The molding process, combining the cellular core with the glass reinforced cement matrix, reduces voids within the concrete and permits accurate edge dimensions, relatively thin concrete, and the ability to formulate simple as well as compound curved shapes.

Having thus summarized the invention, it will be seen that an object thereof is to provide a composite construction panel and method of fabricating same of the general character herein.

Specifically, it is an object of this invention to provide a composite construction panel having a cellular core encased within glass fiber reinforced concrete and the method for forming same.

It is a further object of this invention to provide a method for fabricating a composite construction panel wherein a cellular core is effectively bonded to an outer, relatively thin, concrete encasement.

An additional object of this invention is to provide a composite construction panel having a cellular core of rigid plastic foam for providing weight reduction and insulation.

A still further object of this invention is to provide a composite construction panel incorporating a low density concrete having fire resistant properties.

Another object of this invention is to provide a composite construction panel including lateral ribs having steel reinforcement for compliance with load bearing requirements.

Yet another object of this invention is to provide a composite construction panel and method for fabrication incorporating embedded electrical conduits and providing for access openings.

A further object of this invention is to provide a composite construction panel which is relatively resistant to fire, corrosion, insects, fungus, and other forms of deterioration or weathering.

A still further object of this invention is to provide a composite construction panel which is economical to manufacture and can be prefabricated in curvilinear, rectilinear, or other desired shapes.

Other objects of this invention in part will be obvious and in part will be pointed out hereinafter.

With these ends in view, the invention finds embodiment in certain combinations of elements and arrangements of parts by which the objects aforementioned and certain other objects are hereinafter attained, all as more fully described with reference to the accompanying drawings and the scope of which is more fully pointed out and indicated in the appended claims.

BRIEF DESCRIPTION OF THE DRAWINGS

In the accompanying drawings in which is shown the preferred embodiment of the invention:

FIG. 1 is a perspective view of a greenhouse incorporating a plurality of composite construction panels in accordance with this invention;

FIG. 2 is an isolated perspective view of the composite construction panel illustrated in FIG. 1 being connected to an adjacent panel shown in broken lines;

FIG. 3 is a sectional view to an enlarged scale taken substantially along line 3—3 of FIG. 2 showing the internal structure of the composite construction panel including a foam core, fireproofing layer, fiber reinforced concrete encasement and reinforcing steel;

FIG. 5 is a perspective view to an enlarged scale of a portion of the composite construction panel showing a typical window opening, utility box recess, bolt connection pocket and embedded electrical conduit;

DETAILED DESCRIPTION OF THE INVENTION

Figure 6A:
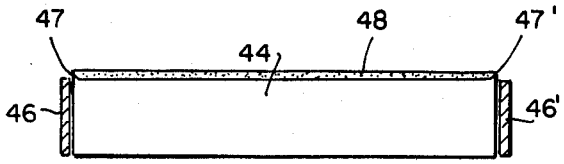
FIG. 6A is a sectional view of a form used for manufacturing the composite construction panel of this invention illustrating the initial step of the process wherein a first layer of fiber reinforced cement is placed upon the form.
Figure 6E:
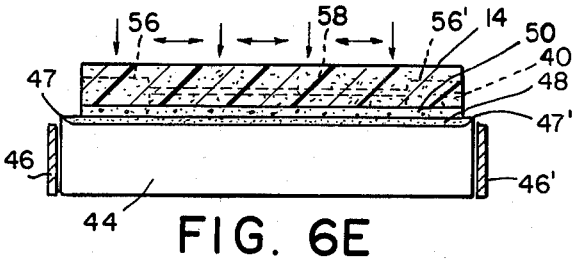
FIG. 6E is a corresponding view of the form shown in FIG. 6B with the cellular foam material removed and positioned upon the second layer of fireproofing cement further indicating that a downward uniform pressure and vibratory action are exerted upon the foam material as denoted by the arrows.

Referring now in detail to the invention, the reference numeral 12 denotes generally a composite construction panel in accordance with and embodying the invention. The construction panel 12 is designed to provide an ecological building component which is energy efficient, light in weight, and economical in cost. For the purpose of illustration, the construction panel 12 is typically shown as having a curvilinear contour for use as a shell wall/roof for a solar greenhouse 14. As noted in FIG. 1, a plurality of construction panels 12 can be utilized for this purpose. Two such typical construction panels 12, 12', as shown in FIG. 2, can be bolt connected and/or adhesively interlocked. It should be understood that the panel 12 can also be precast as a rectilinear component or compound curved element and further can be custom molded, within limitations, to other specific shape requirements. This can be accomplished in accordance with the process of this invention which will be hereinafter described.

The internal structure of the panel 12 will be discussed with reference to the sectional view shown in FIG. 3. A central cellular core 14 provides a relatively lightweight nucleus having acoustical and thermal insulation properties. Preferably, the core 14 is formed of rigid plastic foam such as urethane, polyurethane or similar material. Fireproof protection is provided by a layer of low density fire resistant concrete 16. An outer covering of fiber reinforced concrete 18 surrounds the foam core 14 and fireproof layer 16. In addition, respective pairs of steel reinforcing bars 20, 22 are incorporated in each of a respective lateral rib section 24, 26. The size and spacing of the reinforcing bars 20, 22 can be varied in accordance with the load bearing requirements of the panel 12.

Figure 4:
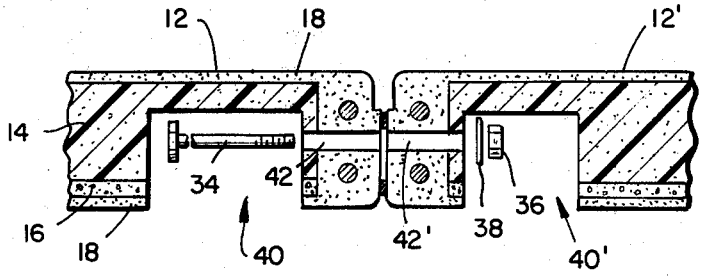
FIG. 4 is a partial sectional view to an enlarged scale taken substantially along line 4—4 of FIG. 2 showing a bolt connection pocket provided in each of the two panels and further illustrating placement of bolt hardware for interconnecting two adjacent construction panels of this invention.

The adjacent panels 12, 12' are secured together by a conventional steel bolt 34, although a high tensile steel bolt can be used if required, a nut 36, and a lock washer 38, as denoted in FIG. 4. Typically, a $\frac{1}{4}$ inch diameter bolt can be used.

In order to obtain a weather barrier, a continuous sealing strip 28, 28', preferably made of a mastic material or other adhesive compound, is placed on a confronting side face 30, 30' of each respective panel 12, 12' as shown in FIG. 3. The sealing strip 28, 28' has been found to effectively seal this juncture and also provide an interfacial interlock. It should be apparent that other sealing materials can be used, e.g. a nonadhesive foam tape gasket, especially if the panels 12, 12' are intended for temporary interconnection. Furthermore, an exterior surface joint 32 is treated with a flexible caulking compound having silicone, butyl or equivalent material, and is then finished in a manner to improve the surface appearance and protect against weather. It should be obvious that the surface joint 32 is formed by surface displacement as a result of the rounded edges on panels 12, 12' which are set back from the side face 30, 30' as by trowelling the concrete 18 prior to setting with a curved tool.

A bolt connection access pocket 40, 40' and a cylindrical bolt passageway 42, 42' are provided by conventional mold inserts during the forming operation or can be drilled soon after the panel 12 is formed. Typically, each of the two panels 12, 12' is assembled by registering the respective bolt passageways 42, 42' and then by fastening with the bolt 34, nut 36, and lock washer 38.

The method of fabricating the panel 12 provides an effective procedure for combining the various materials such that the resultant composite construction panel 12 will have uniform structural integrity. The process for forming the panel 12, as well as the provision for incorporating access openings and conduits, will now be described with reference to FIGS. 6A–6G.

As previously mentioned, the panel 12 is cast or molded; for that purpose a mold or form 44, 44' is constructed preferably of wood, plastic or a combination of the aforementioned materials such that the surface of form 44 defines an interior face of the panel 12. A pair of side flanges 46, 46' and fillet inserts 47, 47' for providing rounded edges are secured by adjustable clamps (not shown) or other conventional apparatus. The form 44, 44' can be fabricated to conform to the desired size and shape of the finished panel including simple and compound curve structures, and it has been found that panel surface areas approximately 250 square feet are a practical limitation. Larger sizes, however, could probably be achieved with the introduction of mechanized equipment and special handling techniques.

At an initial station, a matrix of cement, silica sand, water, polymer solids and pigment, if desired, is prepared to provide a viscous binder mixture. The proportions of a typical mix, relative to cement weight, are as follows: one part high early strength Portland cement, 0.05 to 1.5 parts fine silica sand, 0.30 to 0.40 parts water, 0.01 to 0.15 parts polymer solids and 0.00 to 0.08 parts pigment. It should be noted that in place of the cement an inorganic resin can be used as the binder. Furthermore, it has been observed that the polymer solids in the cement matrix provide compatibility between the urethane core and the concrete and permit effective bonding of these dissimilar materials.

The cement matrix is then pneumatically sprayed by compressed air through a nozzle where it atomizes and is thoroughly mixed with comminuted glass fibers approximately 2 inches in length which are introduced before the combined spray exits from the nozzle. The glass fibers are of an alkali-resistant formulation and constitute about 3–5% by volume of the combined mixture. It is contemplated that fibers of other materials having similar properties could be utilized in place of the glass fibers.

The so formed cement matrix incorporating the glass fibers is spray deposited on the mold 44 in a first layer 48 shown in FIG. 6A, thus forming the interior face of panel 12. In this connection, a desired surface texture or finish for the interior panel face can be imparted by appropriate treatment of the mold surface. The approximate thickness of layer 50 is ¼ inch.

Figure 6B:
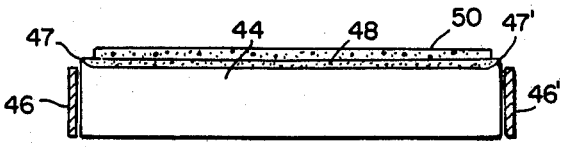
FIG. 6B is a corresponding view of the form shown in FIG. 6A illustrating the next step in the procedure wherein a second layer, of fireproofing cement, is deposited upon the first layer.
Figure 6F:
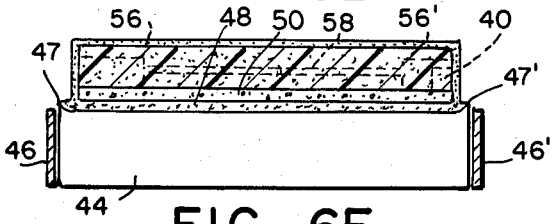
FIG. 6F is a corresponding view of the form shown in FIG. 6E showing the subsequent step in the procedure illustrating a fiber reinforced cement covering along the top and sides of the foam material.
Figure 6C:
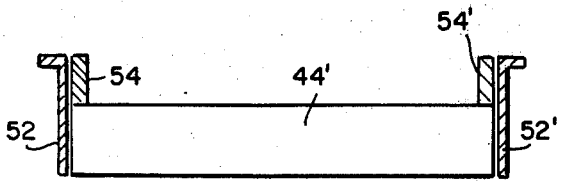
FIG. 6C is a sectional view of a form having substantially identical dimensions to the form of FIG. 6A and further including a pair of raised side flanges and removable lateral spacer inserts.
Figure 6G:
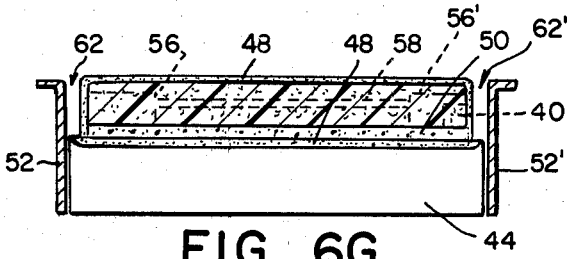
FIG. 6G is a corresponding view of the panel shown in FIG. 6F showing a lateral cavity remaining between the encased foam material and the raised side flanges.

The next step, as illustrated in FIG. 6B, includes the introduction of a layer of fast setting, low density, insulating cement mixture 50 which can contain Zonolite 3300 as sold by W. R. Grace & Co., and is trowelled, pumped or sprayed over the first layer 48 to a depth of between ¼ inch and 1 inch. This layer 50 provides fireproofing protection as well as a bed for receiving and bonding the foam core 14.

In this connection, it should be noted that the core 14 is formed on a mold form 44' being dimentionally identical to form 44. The form 44', however, utilizes a pair of raised side flanges 52, 52' having lateral spacer inserts 54, 54'. A flowable foam material, preferably urethane although a polyurethane or equivalent substance can be used, is sprayed, frothed or otherwise poured into the mold form 44' to a depth of between 2 to 6 inches. This foam material used preferably has a density of less than 5 pounds per cubic foot and provides a thermal transmission coefficient expressed in BTU per hour per square foot per degree Fahrenheit difference in temperature between the air on the two sides of the material of 0.125 to 0.200. In addition, the solidified foam core 14 has a compressive strength of at least 20 pounds per square inch, a shear strength equal or greater than 2 pounds per square inch, and is stable at temperatures of up to 200 degrees Fahrenheit.

It should thus be apparent that the foam core 14, in addition to providing low heat transmission characteristics, also contributes to the shear, compressive and impact strength of the panel 12.

The procedure for preparing the foam core 14 can be conducted independently and prior to the applying of layers 48, 50 and/or simultaneously therewith depending on the forming procedure and number of molds being employed.

Figure 6D:
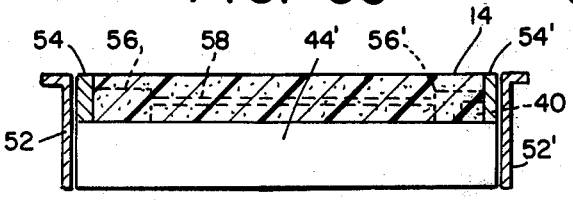
FIG. 6D is a corresponding view of the form shown in FIG. 6C containing a cellular foam material and illustrating, in dotted lines, an embedded electrical conduit and a mold insert for providing a void to accommodate a junction box.
Figure 7:
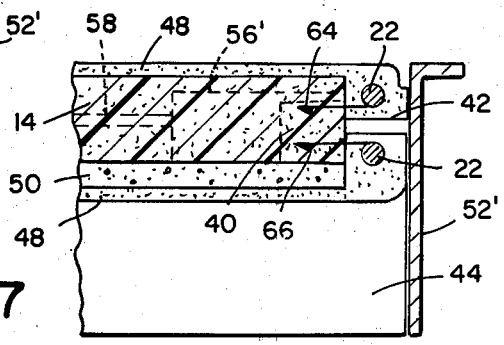
FIG. 7 is a sectional view to an enlarged scale corresponding to FIG. 6G and showing a portion of the encased foam material and illustrating in detail a cylindrical bolt passageway insert a reinforcement steel bar and a fiber reinforced cement infill forming a lateral rib.

In this connection, it should be noted that mold inserts are utilized in a conventional manner to provide void areas as for the bolt connection access pockets 40, 40', and an electrical junction box recess 56, 56'. Furthermore, an electrical conduit 58 can be embedded in the foam core 14 before it solidifies as shown in FIG. 6D. A typical bolt connection access pocket 40, 40' is approximately 2⅛ inches in diameter. The electrical conduit 58 is preferably a flexible type such as Greenfield conduit, which can be curved so as to conform to the panel shape. In a similar fashion, provisions can be made for door and window openings, as well as for ventilation ducts. It should be apparent that after the panel 12 is completed, the concrete layers 48, 50 can be chipped away to expose these void areas. The bolt connection access pockets 40, 40' can also be filled and capped after panel assembly.

Reference is now made to FIG. 5 which shows a portion of a finished panel 12 and illustrates the so formed electrical junction box recess 56 and the embedded electrical circuit 58. It should be pointed out that the electrical system contemplates the use of standard code approved components. The interconnection of respective panels 12, 12', for example, encompasses the utilization of companion electrical junction boxes 56 in each of the panels 12, 12' and an interfitting segment or nipple together with lock nuts for coupling purposes such that an internal network of electrical conduits can be readily assembled.

A typical window opening 62 is also illustrated in FIG. 5. The periphery of the opening 62 is formed with a rib area in a similar manner as described with reference to rib sections 24, 26 with or without reinforcement.

After the foam core 14 has solidified and become rigid, it is removed from form 44' and placed on the cement mixture forming layer 50 which has a consistency providing a workable plasticity. A uniform pressure is applied to the foam core 14, and it is also vibrated to insure contiguous surface contact with layer 50 below as denoted in FIG. 6C. An interfacial adhesive bond will thus be effected as the cement layer 50 sets. After the cement mixture forming layer 50 initially sets, the sides and upper surface of core 14 are spray covered with the cement matrix containing the glass fiber. A coating of approximately ¼ inch thus encapsulates the core 14 as well as layer 50. The flanges 46, 46' are then removed and replaced by flanges 52, 52'. It should be noted that a space within the range of ⅜ to three inches and corresponding substantially to the lateral spacer inserts 54, 54' will now form a respective cavity 62, 62'.

The lateral rib section 24, 26 being coextensive with the sides of the panel 12, is formed by infilling the respective cavity 62, 62' with a premixed glass fiber cement matrix by trowelling or pumping. It should be pointed out that optional steel reinforcing bars 20, 22 can be positioned prior to he infilling procedure. For this purpose, steel wire or thin bars or rods up to about ½ inch diameter are supported by hangers 64, 66. The hangers 64, 66 are wrapped around the respective bars 20, 22 and then inserted into the core 14 before the concrete 48 has been set, thus permitting a deformation of the bars 20, 22 to conform with the contour of the lateral rib section 24, 26. It should be noted that other and similar rib sections can be formed at the opposed ends of the panel, surrounding window and door openings and also passing transversely through the interior of the panel 12 as by routing or slicing grooves in the foam core 14 prior to completion of the core encapsulation; this will further reinforce the panel.

The panel 12 is then cured by means of heating in a moist environment until sufficient strength is developed to allow demolding and reuse of the mold form.

Thus, it will be seen that there is provided a composite construction panel and method which achieves the various objects of the invention and which is well adapted to meet the conditions of practical use. Since various possible embodiments might be made of the present invention and various changes might be made in the exemplary embodiments and methods above set forth, it is to be understood that all material shown and described in the accompanying drawings is to be interpreted as illustrative and not in a limiting sense.

Having thus described the invention, there is claimed as new and desired to be secured by Letters Patent:

1. A molded composite construction panel formed in a continuous molding procedure and suitable for casting curvilinear structural components comprising a lightweight cellular core of rigid foam material, said core having a cementaceous fireproofing layer interfacially bonded to one side of said core, a relatively thin skin of sprayed glass fiber reinforced concrete encasing said core and fireproofing layer, said panel further including at least one integrally formed lateral rib section of said fiber reinforced concrete, said rib section being coextensive with at least one side of the panel and including connection means for securing adjacently placed panels.

2. A molded composite construction panel as claimed in claim 1 wherein the glass fiber reinforced concrete is prepared from a matrix of cement, silica sand, water and polymer solids to form a sprayable viscous binder mixture.

3. A molded composite construction panel as claimed in claim 2 wherein the viscous binder mixture contains between 0.01 and 0.15 parts polymer solids relative to cement by weight.

4. A molded composite construction panel as claimed in claim 3 wherein the viscous binder mixture is atomized and mixed with comminuted glass fibers constituting 3% to 5% by volume of the combined mixture.

5. A molded composite construction panel as claimed in claim 2 wherein the fireproofing layer is comprised of a fast setting, low density, insulating cement mixture having a thickness of between 0.25 and 1.0 inch.

6. A molded composite construction panel as claimed in claim 1 wherein the lateral rib section further defines passageway means for accommodating a connector bolt, said passageway means of adjacent panels being registrable for securement by said connector bolt.

7. A molded composite construction panel as claimed in claim 1 further including a lateral rib section on opposed sides of said panel and steel reinforcement means within said lateral rib sections for increasing the load bearing capacity of the panel.

8. A molded composite construction panel as claimed in claim 1 further including electrical conduit means embedded within said panel during the molding procedure with respective conduits being adapted for interconnection upon securement of said panels to form an internal electrical conduit network.

9. A molded composite construction panel as claimed in claim 8 wherein said panel is further provided with recess means in communication with an end of said conduit, said recess means being adapted for receiving an electrical junction box.

10. A molded composite construction panel as claimed in claim 6 wherein the panel is provided with an access pocket, said access pocket being in communication with the passageway means for facilitating installation and removal of the bolt connector and a companion nut.

* * * * *